US012305482B2

(12) United States Patent
McCarthy et al.

(10) Patent No.: US 12,305,482 B2
(45) Date of Patent: May 20, 2025

(54) DOWNHOLE SHUNT TUBE ISOLATION VALVE SYSTEM

(71) Applicant: Halliburton Energy Services, Inc., Houston, TX (US)

(72) Inventors: Finn Gamble McCarthy, Carrollton, TX (US); Edmund Christopher Williamson, Carrollton, TX (US); Stephen Michael Greci, Carrollton, TX (US); Ryan M. Novelen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/499,022

(22) Filed: Oct. 31, 2023

(65) Prior Publication Data

US 2025/0137352 A1 May 1, 2025

(51) Int. Cl.
*E21B 34/14* (2006.01)
*E21B 43/04* (2006.01)

(52) U.S. Cl.
CPC ..... *E21B 34/14* (2013.01); *E21B 43/04* (2013.01)

(58) Field of Classification Search
CPC ..... E21B 34/14; E21B 43/04
See application file for complete search history.

(56) References Cited

U.S. PATENT DOCUMENTS 5,113,935 A * 5/1992 Jones ..... E21B 43/04 166/278
5,390,966 A * 2/1995 Cox ..... E21B 17/085 166/241.6
6,298,916 B1 * 10/2001 Tibbles ..... E21B 34/14 166/149
8,453,734 B2 6/2013 Jasek et al.
9,637,999 B2 5/2017 Garcia et al.
11,293,270 B2 4/2022 Malone et al.
2007/0044962 A1 3/2007 Tibbles
2010/0096119 A1 * 4/2010 Sevre ..... E21B 33/1294 166/51
2012/0312547 A1 * 12/2012 Miller ..... E21B 34/142 166/373
2013/0082202 A1 * 4/2013 Morrison ..... E21B 33/14 251/315.01
2015/0041130 A1 2/2015 Cleveland et al.
(Continued)

OTHER PUBLICATIONS

"PCT Application No. PCT/US2023/078292 International Search Report and Written Opinion", Jul. 23, 2024, 12 pages.

*Primary Examiner* — James G Sayre

(74) *Attorney, Agent, or Firm* — DeLizio, Peacock, Lewin & Guerra LLP

(57) ABSTRACT

A downhole shunt tube isolation system having a fluid channel and a piston hydraulic chamber disposed within a valve actuator housing, wherein the fluid channel is sealed via a plug to hydraulically lock a valve in an open position, wherein a gravel slurry is configured to flow from a first tube segment through the valve to a second tube segment when the valve is in the open position. A portion of the plug is displaced to open a fluid path through the plug to the piston hydraulic chamber, wherein opening the fluid path to the piston hydraulic chamber hydraulically unlocks the valve, closing the valve via a biasing force to block the flow of the gravel slurry from a first tube segment through the valve to a second tube segment.

19 Claims, 8 Drawing Sheets

(56) References Cited

U.S. PATENT DOCUMENTS

| | | | | |
|---|---|---|---|---|
| 2017/0058644 | A1* | 3/2017 | Andreychuk | E21B 34/14 |
| 2021/0140280 | A1 | 5/2021 | Malone et al. | |
| 2023/0113839 | A1* | 4/2023 | Greci | E21B 43/04<br>166/373 |

* cited by examiner

DOWNHOLE SHUNT TUBE ISOLATION VALVE SYSTEM

BACKGROUND

In some well completions, a gravel packing operation may be employed to provide filtration to keep sand in unstable production zones from entering a well stream. The gravel packing operation may include pumping a gravel slurry into a well having a plurality of production zones. In one approach, packers are set in the well to separate the well into production zones. If the packers are set prior to placing the gravel slurry, then the packers may include bypass holes such that the gravel slurry may pass through the bypass holes via corresponding shunt tubes extending through the bypass holes. Unfortunately, although the use of shunt tubes may be advantageous to fluidly connect the production zones for gravel packing, that same fluid connection makes it difficult to prevent fluids (e.g., natural gas or water) from flowing through the shunt tubes into adjacent production zones in the event of a breakthrough or similar event.

BRIEF DESCRIPTION OF THE DRAWINGS

Embodiments of the disclosure may be better understood by referencing the accompanying drawings.

Like reference numbers and designations in the various drawings indicate like elements.

DETAILED DESCRIPTION

Figure 1:
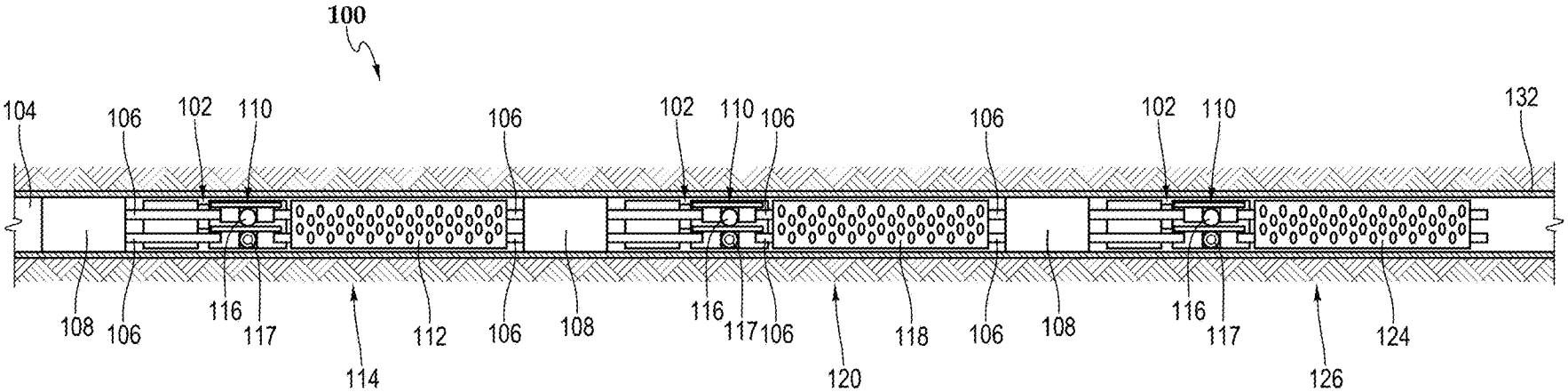
FIG. 1 illustrates a side elevation, partial cross-section view of an example operational environment for a well completion system.

Disclosed herein are systems and methods for actuating a downhole shunt tube isolation system from an open position to a closed position. At least one shunt tube may extend through bypasses in packer assemblies to fluidly connect adjacent production zones such that gravel slurry may be pumped into the well through the packer assemblies and to each production zone. However, as noted above, fluidly connecting the production zone may leave all the production zones vulnerable to a breakthrough in a single production zone. Thus, at least for the reason of isolating potential breakthroughs to a single production zone, the downhole shunt tube isolation system may actuate from an open position to a closed position to isolate each production zone. Moving to the close position decouples a first segment of the shunt tube from a second segment of the shunt tube at the downhole shunt tube isolation system to isolate the adjacent production zones. In some embodiments, multiple downhole shunt tube isolation systems may be actuated to isolate one or more production zones in the well.

The description that follows includes example systems, methods, techniques, and program flows that embody the present disclosure. Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

A downhole shunt tube isolation system is described that has a fluid channel and a piston hydraulic chamber, both disposed within a valve actuator housing. The fluid channel is sealed via a plug to hydraulically lock a valve in an open position so that a gravel slurry can flow from a first tube segment through the valve to a second tube segment. A portion of the plug may be displaced to open a fluid path through the plug to the piston hydraulic chamber, wherein opening the fluid path to the piston hydraulic chamber hydraulically unlocks the valve, closing the valve via a biasing force to block the flow of the gravel slurry from the first tube segment through the valve to the second tube segment.

In one example approach, a downhole shunt tube isolation system includes a first slurry tube segment; a second slurry tube segment; a valve housing connected to the first and second slurry tube segments, the valve housing including a valve and a valve linkage, the valve moveable between an open position and a closed position via the valve linkage, the valve having a slurry pathway extending through at least a portion of the valve housing, wherein the slurry pathway fluidically couples the first slurry tube segment to the second slurry tube segment with the valve in the open position and fluidically decouples the first slurry tube segment from the second slurry tube segment with the valve in the closed position; and a valve actuation housing connected to the valve housing, the valve actuation housing including a valve actuator connected to the valve linkage; a fluid channel connected to the valve actuator, the fluid channel initially closed to hydraulically lock the valve in the open position; and an actuation mechanism connected to the fluid channel and the valve actuator, the actuation mechanism configured to open the fluid channel to hydraulically unlock the valve, wherein opening the fluid channel generates a pressure differential that causes the valve actuator to move the valve from an open to a closed position.

In another example approach, a downhole shunt tube isolation system includes a first slurry tube segment; a second slurry tube segment; a valve housing, the valve housing including a valve connected to the first slurry tube segment and the second slurry tube segment, the valve configured to establish a gravel slurry pathway through the first slurry tube segment and the second slurry tube segment when the valve is in an open position and to block flow of the gravel slurry from the first tube segment to the second tube segment with the valve is in a closed position; and a valve actuation housing having a piston hydraulic chamber, a central bore extending axially through the valve actuation housing, and a fluid channel extending from the central bore to the piston hydraulic chamber, wherein the piston hydraulic chamber operates with respect to a pressure differential to cause a valve actuator to move the valve from an open to a closed position; wherein the fluid channel includes a plug disposed within the fluid channel to seal the piston hydraulic chamber from the central bore, wherein sealing the fluid channel hydraulically locks the valve in the open position, and an actuation mechanism connected to the fluid channel, the actuation mechanism configured to open the fluid channel to hydraulically unlock the valve, wherein opening the fluid channel generates a pressure differential that causes a valve actuator to move the valve from an open to a closed position.

In yet another example approach, a method for actuating a downhole shunt tube isolation system includes sealing a piston hydraulic chamber disposed within a valve actuator housing, via a plug, to hydraulically lock a valve in an open position, wherein a gravel slurry is configured to flow from a first tube segment through the valve to a second tube segment when the valve is in the open position; displacing a portion of the plug to open a fluid path through the plug to the piston hydraulic chamber, wherein opening the fluid path to the piston hydraulic chamber hydraulically unlocks the valve; and closing the valve via biasing force to block the flow of the gravel slurry from the first tube segment to the second tube segment, wherein the biasing force is generated by a pressure differential across the piston with the fluid path opened.

In the following description, the example approach uses a ball valve. Other types of valves may be used as well, including pinch valves or a gate valves to interrupt the flow of gravel slurry between first and second slurry tube segments. Each of these types of valve has the advantage of reducing the amount of slurry that must be displaced to isolate the shunt tubes, while allowing for the use of an inline mechanism within a straight shunt pipe through the borehole (reducing erosion within the isolation system due to changes in the slurry path). Finally, the approaches described in the example approaches are irreversible. That is, since the isolation mechanism is not mechanically coupled to the inner sleeve, the isolation system maintains isolation no matter what happens to, for instance, the inner sleeve.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 illustrates a side elevation, partial cross-section view of an example operational environment for a well completion system 100. In the example shown in FIG. 1, three downhole shunt tube isolation systems 102 are installed in a well 104 during completion operations. In one such example, each downhole shunt tube isolation system 102 includes a packer 108, a shunt tube isolation mechanism 110 and one or more shunt tubes 106. In the example shown in FIG. 1, the one or more shunt tubes 106 extend from the packer 108 of each system 102 through the shunt tube isolation mechanism 110 to the screen joint 112 for the isolation system 102. In some such examples, the one or more shunt tubes 106 also extend from screen joint 112 through the packer 108 of adjacent downhole shunt tube isolation systems 102, as shown in FIG. 1.

In one example approach, the three downhole shunt tube isolation systems 102 are connected via shunt tubes 106, which fluidly connect adjacent production zones 114, 120 and 126 such that gravel slurry may be pumped into the production zones within the well 104 through the shunt tubes 106. In one such example approach, gravel slurry may be pumped via shunt tubes 106 through a first packer 108, through a first downhole shunt tube isolation system 110 and through a screen joint 112 to a second packer 108. The gravel slurry may further be pumped via shunt tubes 106 through the second packer 108, through a second downhole shunt tube isolation mechanism 110, through a screen joint 118 to a third packer 108, through a third downhole shunt tube isolation mechanism 110, and through a third screen joint 124. The shunt tubes 106, therefore, fluidly connect each production zone (e.g., a first production zone 114, a second production zone 120, and a third production zone 126) such that gravel slurry may be placed in each production zone to provide filtration. The production zones 114, 120, 126 are separated via the packers 108, which expand to form seals against an inner surface of a casing 132. As the gravel slurry flows through the shunt tubes 106, a portion of the gravel slurry may be diverted into each production zone 114, 120, 126 via the respective screen joints 112, 118, 124 to gravel pack the respective production zones 114, 120, 126.

In the event of a breakthrough, fluids (e.g., natural gas or water) may flow into the shunt tubes 106 at a screen joint. Thus, to isolate each production zone, at least one downhole shunt tube isolation system 102 may be installed between each screen joint. For example, to isolate the second production zone 120 the second and third downhole shunt tube isolation systems 102 may be actuated from respective open to respective closed positions. As the second downhole shunt tube isolation system 102 is disposed between the first screen joint 112 and the second screen joint 118, closing the second downhole shunt tube isolation system 102 isolates the second production zone 120 from the first production zone 114. Further, as the third downhole shunt tube isolation system 102 is disposed between the second screen joint 118 and the third screen joint 124, closing the third downhole shunt tube isolation system 102 isolates the second production zone 120 from the third production zone 126. Thus, closing the second downhole shunt tube isolation system 102 and third downhole shunt tube isolation system 102 may fluidly isolate the second screen joint 118 from the adjacent screen joints 112, 124 to contain the breakthrough to the second production zone 120. In one example approach, each shunt tube isolation mechanism 110 includes a ball valve 116 in open position and a ball valve 117 in closed position.

In some examples, screen joints 112, 118 124 include two or more screen joints joined to cover a larger production zone. Still, only a single shunt tube isolation system 102 is needed between each adjacent packer 108 to isolate the respective production zones 114, 120, 126. For example, the second shunt tube isolation system 102 may be disposed between the second packer 108 and the second screen joint 118, and additional screen joints (not shown) may be disposed between the second screen joint 118 and the third packer 108. The third shunt tube isolation system 102 may be disposed between the third packer 120 and the third screen joint 124. Although the completion system 100 includes multiple screen joints between the second and third packers 108, closing the second shunt tube isolation system 102 and the third shunt tube isolation system 102 still isolates the second production zone 120 from the first production zone 114 and the third production zone 126, respectively.

Figure 2:
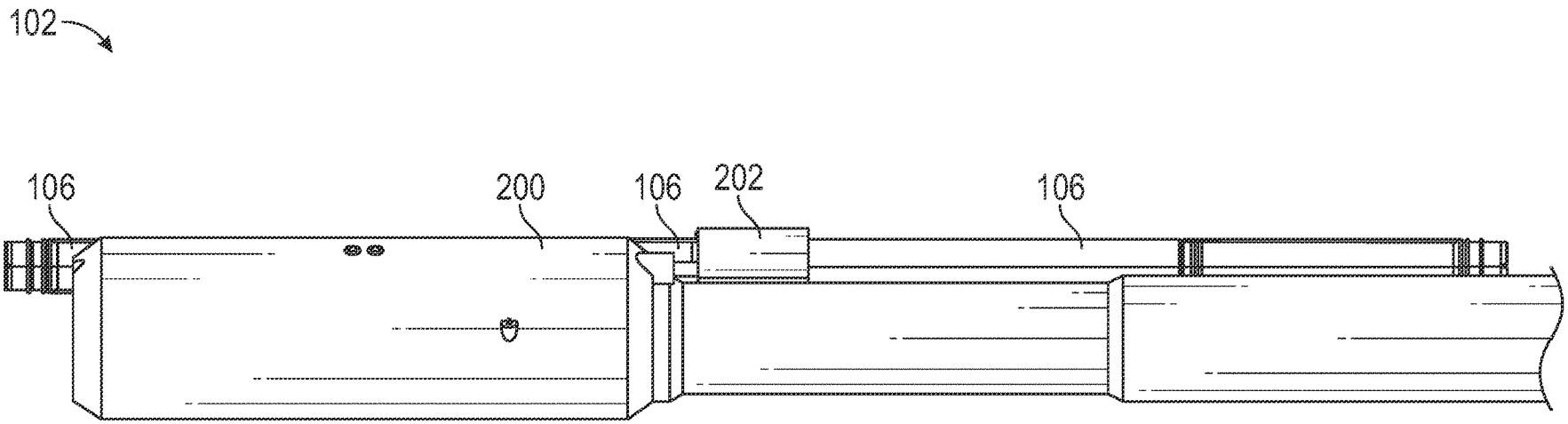
FIG. 2 illustrates a perspective view of a shunt tube isolation system of the well completion system.

FIG. 2 illustrates a perspective view of a shunt tube isolation system 102 of the well completion system 100. In the illustrated example, shunt tube isolation system 102 includes a valve actuation housing 200 and two valve housings 202, and a shunt tube 106. In one example, the valve housing 202 includes a valve connected to a first and a second slurry tube segment of shunt tube 106. As described in further detail below, the valve operates under control of a valve actuator to move between an open position and a closed position. When the valve is in an open position, the first and second slurry tube segments of shunt tube 106 form a slurry pathway extending through at least a portion of the valve housing 202. When, however, the valve is in a closed position, the valve fluidically decouples the first slurry tube segment from the second slurry tube segment.

Figure 3:
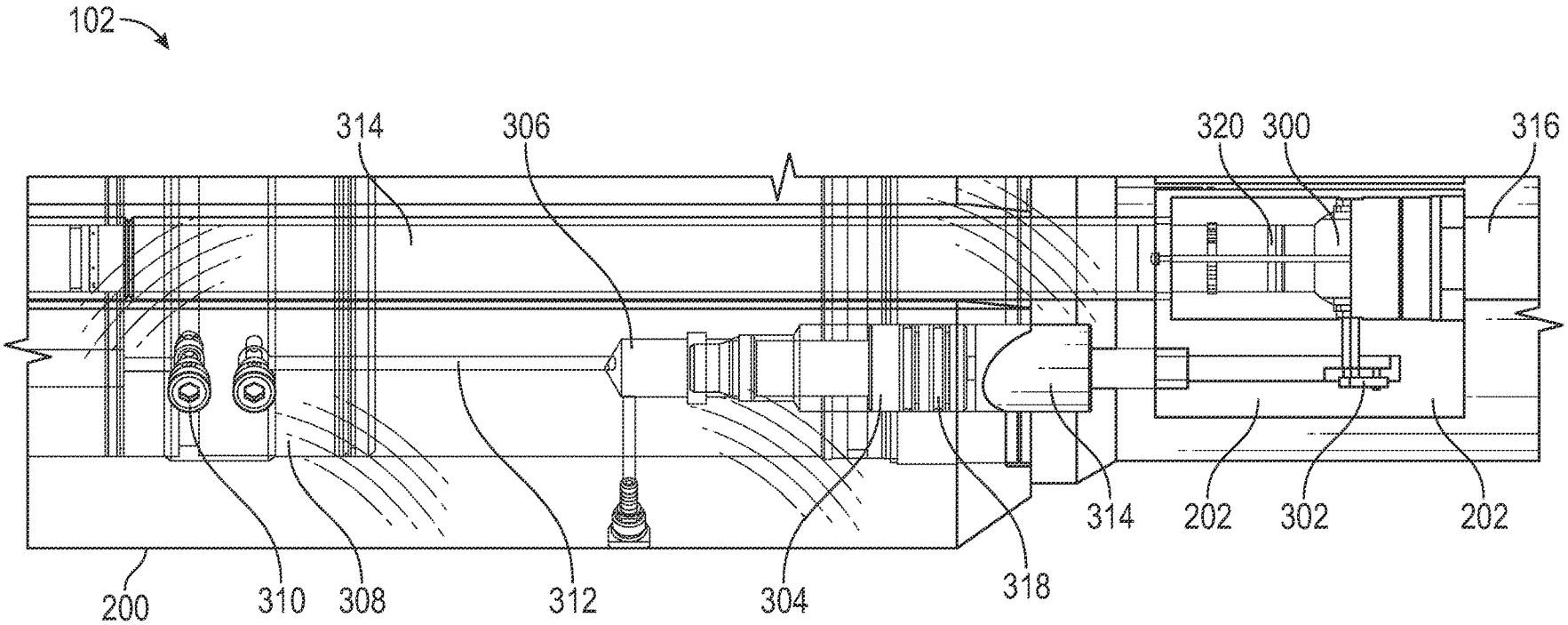
FIG. 3 illustrates a cross-sectional view of the shunt tube isolation system of FIG. 2 with the ball valve in an open position.
Figure 4:
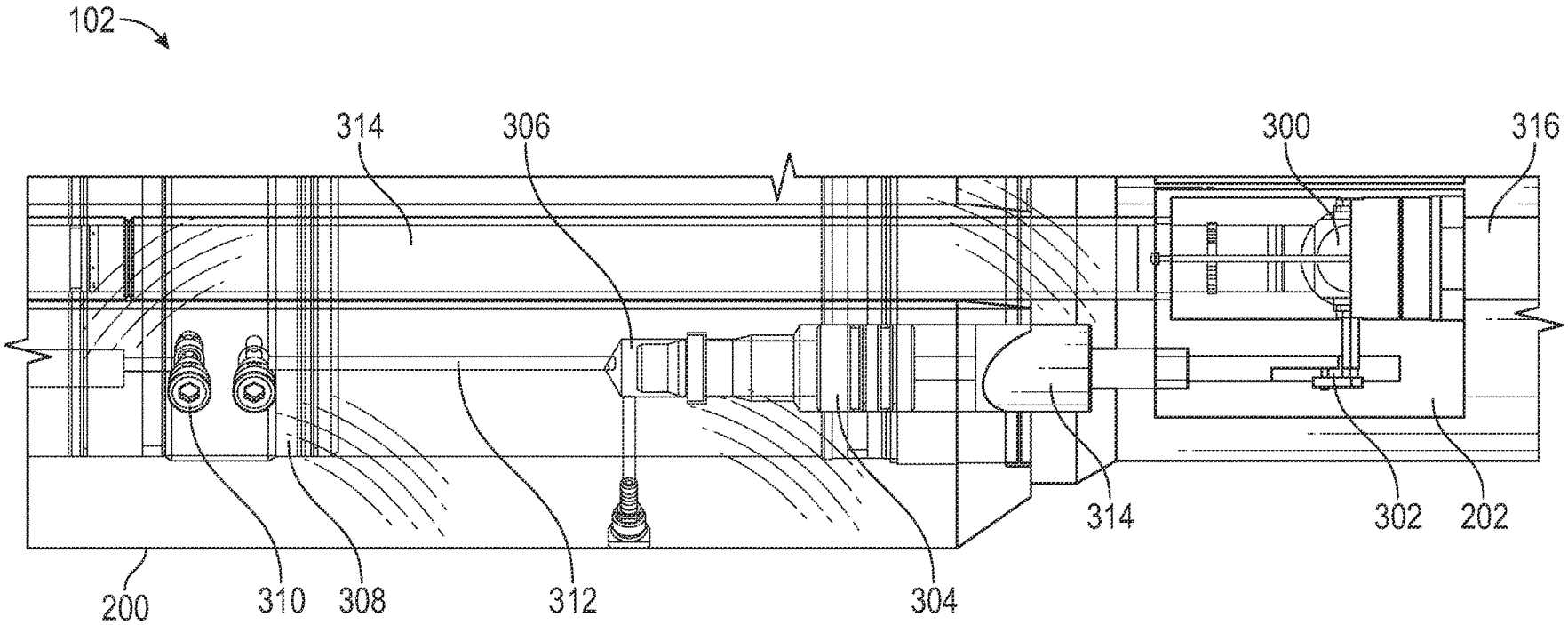
FIG. 4 illustrates a cross-sectional view of the shunt tube isolation system of FIG. 2 with the ball valve in a closed position.

FIGS. 3 and 4 illustrate cross-sectional views of the shunt tube isolation system of FIG. 2 with the ball valve in an open position and a closed position, respectively. In the example shown in FIG. 3, the downhole shunt tube isolation system 102 includes a valve actuation housing 200, a first and a second valve housing 202, and a first and a second shunt tube 106 connected to the first and second valve housings 202 respectively. As can be seen in FIG. 3, the first shunt tube 106 extends through the valve actuation housing 200 and the first valve housing 202 while the second shunt tube 106 extends through the valve actuation housing 200 and the second valve housing 202.

In one example approach, as shown in FIG. 3, the valve housing 202 includes a ball valve 300 connected to a lever arm 302. The valve actuation housing 200 includes a piston 304 with a hydraulic chamber 306. Piston 304 acts under hydraulic pressure to press against the lever arm 302, converting linear motion from piston 304 into rotational motion of ball valve 300 to move the ball valve 300 to the closed position. The valve actuation housing further includes an inner sleeve 308 which, when moved in a lateral direction, breaks a knock off plug 310. The knock off plug 310, once broken, draws hydraulic fluid away from hydraulic chamber 306 via tube 312, pulling piston 304 laterally away from valve housing 202. As can be seen in FIG. 4, the motion pulling piston 304 away from valve housing 202 acts on lever arm 302, rotating ball valve 300 into a closed position.

In one example approach, inner sleeve 308 is mechanically shifted during washpipe removal. The movement of the inner sleeve 308 breaks knock off plug 310, which allows communication between an oil chamber and an atmospheric chamber. Differential pressure forces piston 304 to shift closed. The linear motion of the piston 304 is converted to rotational motion via lever arm 302, forcing ball valve 300 into a closed position.

In the examples shown in FIGS. 3 and 4, ball valve 300 is connected to a first slurry tube segment 314 of shunt tube 106 and to a second slurry tube segment 316 of shunt tube 106. When ball valve 300 is in an open position, the first and second slurry tube segments of shunt tube 106 form a slurry pathway extending through at least a portion of the valve housing 202. When, however, the valve is in a closed position, the valve fluidically decouples the first slurry tube segment from the second slurry tube segment. In some example approaches, piston 304 includes a piston housing 314.

In the illustrated embodiment, the first slurry tube segment of shunt tube 106 is sealed against a radially inner surface of the ball valve 300. The seal may include one or more annular seals 320 disposed between the radially outer surface of slurry tube segment 314 of shunt tube 106 and the radially inner surface of an inlet to ball valve 300.

In other example approaches, ball valve 300 may be replaced with, for instance, a pinch valve or a gate valve to interrupt the flow of gravel slurry between the first and second slurry tube segments in FIG. 3. Each type of valve has the advantage of reducing the amount of slurry that must be displaced to isolate the shunt tubes 106, while allowing for the use of an inline mechanism within a straight shunt pipe 106 through the borehole (reducing erosion within the isolation system due to changes in the slurry path). Finally, the approaches described the example approaches of FIGS. 3 and 4 are irreversible. That is, since the isolation mechanism is not mechanically coupled to the inner sleeve, isolation system maintains isolation no matter what happens to the inner sleeve.

In some example approaches, piston 304 includes a piston housing 314. In the open position, the piston 304 may be disposed in the piston housing 314 in a position proximate the hydraulic chamber 306. The piston 304 may include one or more annular piston seals 318 configured to seal the piston 304 against a radially inner surface of the piston housing 314. Further, the piston 304 may be configured to slide axially along the radially inner surface of the piston housing 314, in a direction toward the channel 312, as the shunt tube isolation system 102 transitions from the open position to the closed position (shown in FIG. 4). In the illustrated embodiment of FIG. 3, the shunt tube isolation system 102 is in the open position.

Moreover, in the open position, the piston hydraulic chamber 306 may be filled with a hydraulic fluid (e.g., oil). In particular, the hydraulic fluid is configured to fill a space in the piston hydraulic chamber 310.

Figure 5:
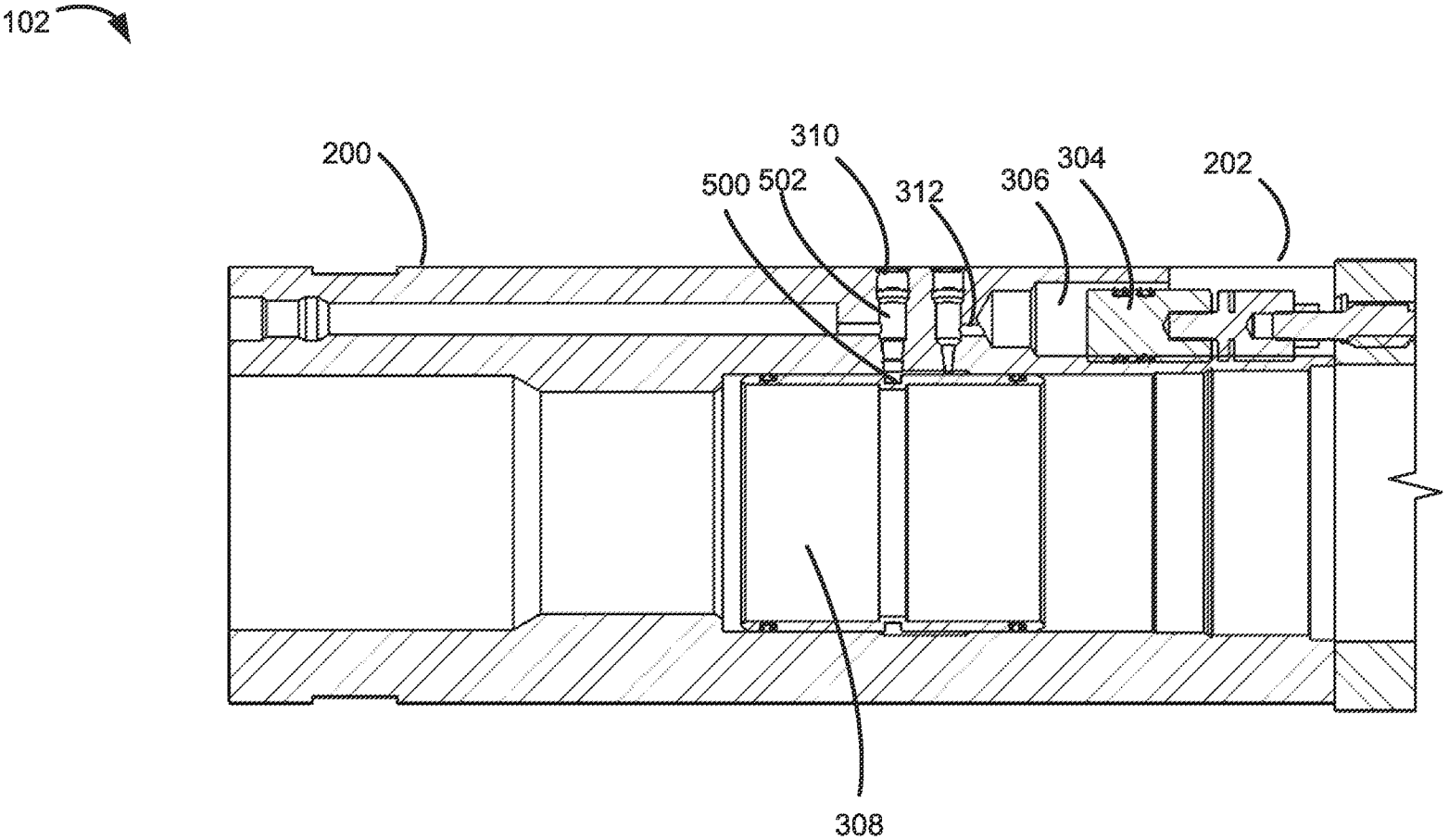
FIG. 5 illustrates a cross-sectional view of the shunt tube isolation system of FIGS. 2 and 5 in a closed position.
Figure 6:
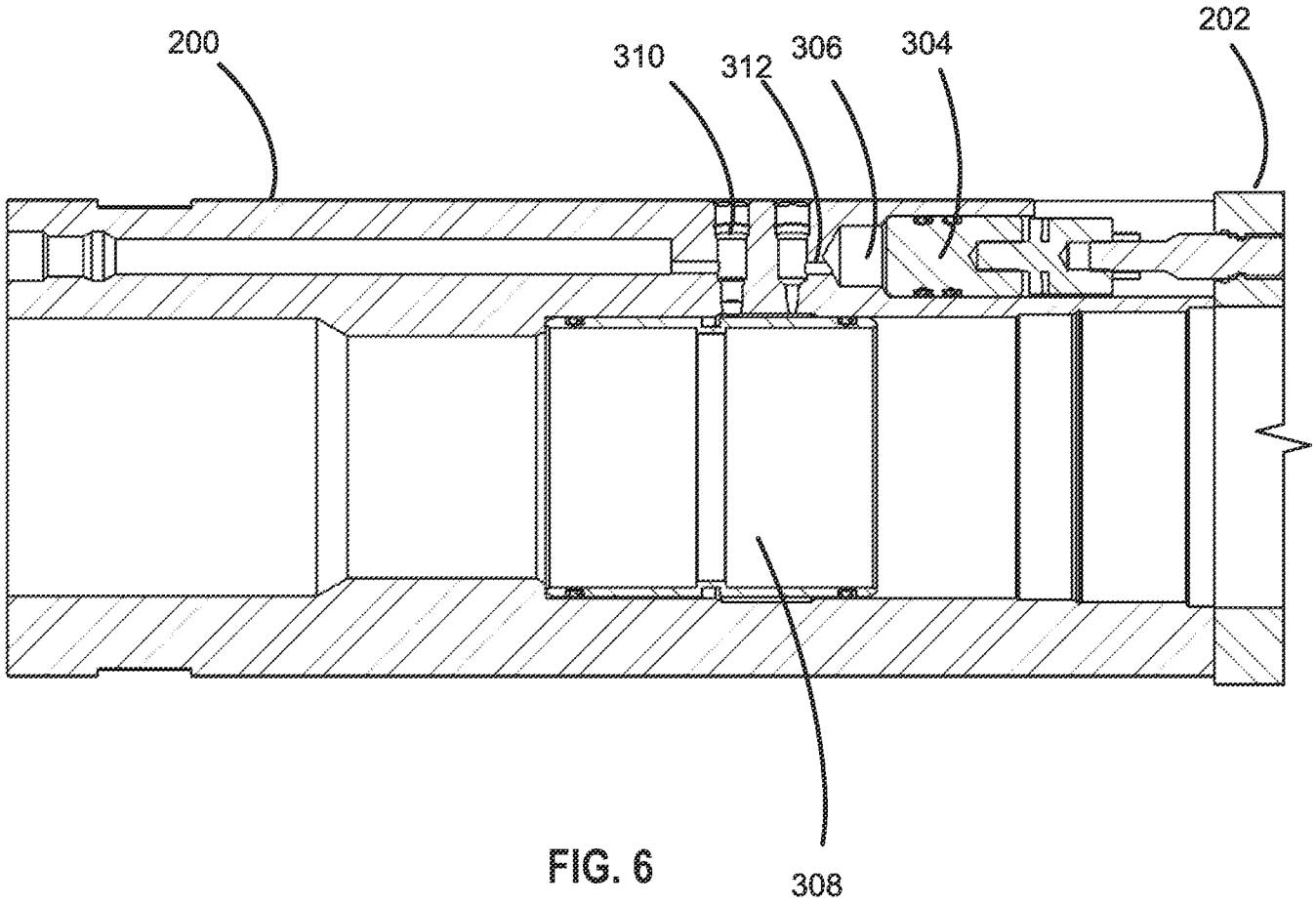
FIG. 6 illustrates a cross-sectional view of the shunt tube isolation system of FIGS. 3 and 6 in a closed and open position.

FIGS. 5 and 6 illustrate cross-sectional views of the shunt tube isolation system 102 in a closed and open position, respectively. As set forth above, the plug 310 hydraulically locks the ball valve 300 in the open position (shown in FIG. 3) by sealing the piston hydraulic chamber 306. That is, the plug 310 seals the channel 502 that fluidly connects the central bore 104 to the piston hydraulic chamber 306. Moreover, the shunt tube isolation system 102 includes an actuation mechanism 500 configured to open the channel 502; thereby, hydraulically unlocking the ball valve 300. Opening the channel 502 may result in a pressure differential across the piston 304 that drives the ball valve 300 to the closed position (as shown in FIG. 3).

In some examples, the actuation mechanism 500 may include a hydraulic device configured to displace a portion of the plug 310 to open a fluid path 502 through the plug 310 such that fluid from the central bore 104 may pass through the channel 502 to the piston hydraulic chamber 306. In the illustrated embodiment, the actuation mechanism 500 includes a mechanical device configured to displace a portion of the plug 310 to open a fluid path 502 through the plug 310. Specifically, the actuation mechanism 500 includes an inner sleeve 308 disposed within the central bore 104 of the valve actuation housing 200. The inner sleeve 308 is configured to slide along the valve actuation housing 200 to displace an inner tip portion of the plug 310 and open the fluid path 502 through the plug 310 to the piston hydraulic chamber 306. In one example approach, the inner tip portion of plug 310 may extend out of the channel 502 toward the central bore 104.

As illustrated, the inner sleeve 308 slides along the central bore 104 to an actuated position. In some embodiments, the inner sleeve 308 may be configured to lock in the actuated position to restrain the inner sleeve 308 from further movement. Moreover, in the actuated position, the borehole 512 extending through the inner sleeve 504 may align with the fluid path 502 through the plug 310 to fluidly connect the central bore 104 to the fluid path 502 through the plug 310. FIG. 6 illustrates such a fluidly connected isolation system 102.

Figure 7:
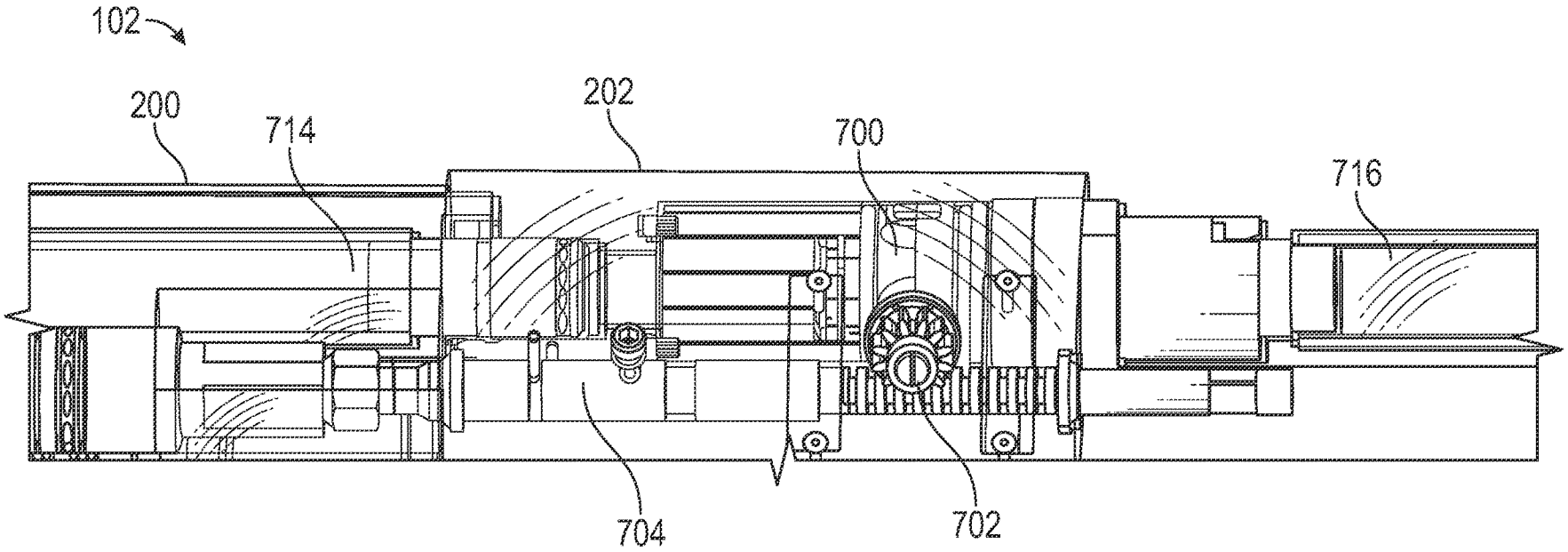
FIG. 7 illustrates a cross-sectional view of another example approach for shunt tube isolation system of FIG. 2 with the ball valve in a closed position.

FIG. 7 illustrates a cross-sectional view of a shunt tube isolation system of FIG. 2 with a valve in a closed position. In the example shown in FIG. 7, the downhole shunt tube isolation system 102 includes a valve actuation housing 200, a valve housing 202, a first slurry tube segment 714 and to a second slurry tube segment 716, each slurry tube segment 714, 716 connected to the valve housing 202. As can be seen in FIG. 7, the first slurry tube segment 714 extends through the valve actuation housing 200 to the valve housing 202.

In one example approach, as shown in FIG. 7, the valve housing 202 includes a ball valve 700 connected to a rack 704 through a pinion 702. Other actuators may be used as well, including a worm screw and worm gear mechanism. Once again, differential pressure may be used to engage the actuator, forcing ball valve 700 into a closed position.

Figure 8:
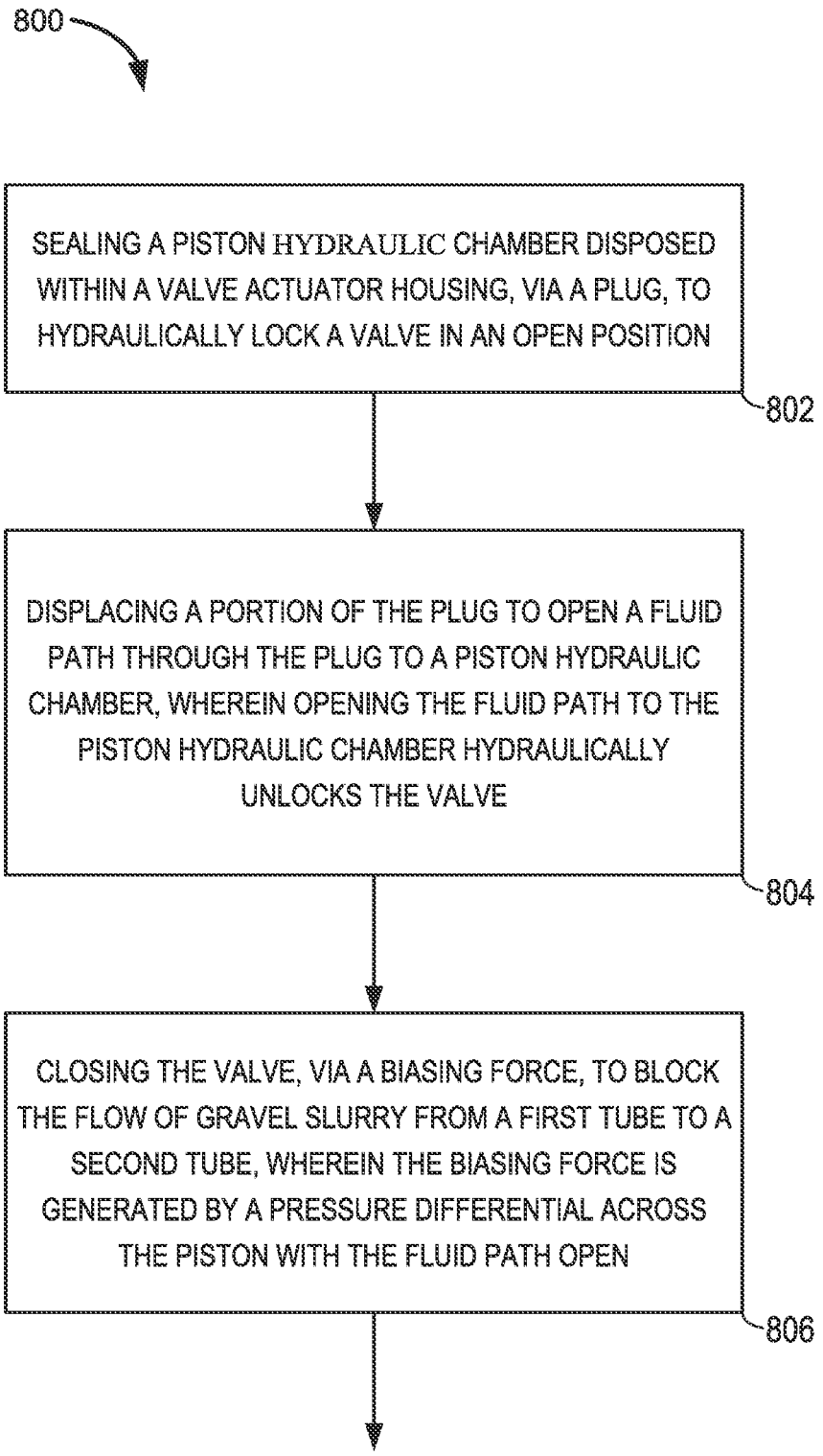
FIG. 8 is a flowchart illustrating a method for actuating the downhole shunt tube isolation system from an open position to a closed position.

FIG. 8 illustrates a flow chart 800 of a method for actuating the downhole shunt tube isolation system 102 from the open position to the closed position. The method includes sealing a piston chamber disposed within a valve actuation housing, via a plug, to hydraulically lock a valve in an open position (block 802). As set forth above, a gravel slurry is configured to flow from a first tube segment 314, 714 to a second tube segment 316, 716, via the valve 300, 700 placed in an open position while the valve is hydraulically locked in an open position. In one example approach, the plug is a knock off plug that is opened by a shift of an inner sleeve 308 disposed within the valve actuation housing 200.

In the example approach of FIG. 8, the method further includes actuating the inner sleeve disposed within the valve actuation housing 200 to displace a portion of the plug and open a fluid path through the plug to the piston chamber, wherein opening the fluid path to the piston chamber hydraulically unlocks the ball valve. The method further includes closing the valve (block 806), via a biasing force, to block the flow of gravel slurry from a first tube to a second tube, wherein the biasing force may be generated by a pressure differential across the piston with the fluid path open.

Accordingly, the present disclosure may provide shunt tube isolation systems configured to actuate from an open position to a closed position to fluidly decouple a first shunt tube segment from a second shunt tube segment, which may isolate adjacent production zones in a well. The shunt tube isolation system may include any of the various features disclosed herein, including one or more of the following statements.

It will be understood that one or more blocks of the flowchart illustrations and/or block diagrams, and combinations of blocks in the flowchart illustrations and/or block diagrams, may be implemented by program code. The program code may be provided to a processor of a general-purpose computer, special-purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Example Embodiments

Embodiment #1: A downhole shunt tube isolation system, including a first slurry tube segment; a second slurry tube segment; a valve housing connected to the first and second slurry tube segments, the valve housing including a valve and a valve linkage, the valve moveable between an open position and a closed position via the valve linkage, the valve having a slurry pathway extending through at least a portion of the valve housing, wherein the slurry pathway fluidically couples the first slurry tube segment to the second slurry tube segment with the valve in the open position and fluidically decouples the first slurry tube segment from the second slurry tube segment with the valve in the closed position; and a valve actuation housing connected to the valve housing, the valve actuation housing including: a valve actuator connected to the valve linkage; a fluid channel connected to the valve actuator, the fluid channel initially closed to hydraulically lock the valve in the open position; and an actuation mechanism connected to the fluid channel and the valve actuator, the actuation mechanism configured to open the fluid channel to hydraulically unlock the valve, wherein opening the fluid channel generates a pressure differential that causes the valve actuator to move the valve from an open to a closed position.

Embodiment #2: The system of Embodiment #1, wherein the valve is an in-line valve that may be placed between the first and second slurry tube segments to fluidically couple the first slurry tube segment, the valve and the second slurry tube segment in an approximately straight slurry pathway.

Embodiment #3: The system of Embodiment #1, wherein the valve is an in-line valve that may be actuated to fluidically decouple the first slurry tube segment from the second slurry tube segment.

Embodiment #4: The system of Embodiment #3, wherein the in-line valve includes at least one of a ball valve, a pinch valve, or a gate valve.

Embodiment #5: The system of Embodiment #1, wherein the valve actuator closes the valve via the valve linkage when the fluid channel is open.

Embodiment #6: The system of Embodiment #5, wherein the valve actuator is a piston and the valve linkage is a lever arm connected to the valve.

Embodiment #7: The system of Embodiment #5, wherein the valve actuator is a piston and the valve linkage is a worm drive with a worm gear connected to the valve.

Embodiment #8: The system of Embodiment #5, wherein the valve actuator is a piston and the valve linkage is a rack with a pinion connected to the valve.

Embodiment #9: The system of Embodiment #1, wherein the actuation mechanism includes a knockout plug positioned in the fluid channel to close the fluid channel, and a mechanical device configured to displace a portion of the plug to open a fluid path through the plug into the fluid channel to open the fluid channel.

Embodiment #10: The system of Embodiment #9, wherein the mechanical device includes a hydraulic device configured to displace the portion of the plug to open the fluid channel.

Embodiment #11: A downhole shunt tube isolation system, including a first slurry tube segment; a second slurry tube segment; a valve housing, the valve housing including a valve connected to the first slurry tube segment and the second slurry tube segment, the valve configured to establish a gravel slurry pathway through the first slurry tube segment and the second slurry tube segment when the valve is in an open position and to block flow of the gravel slurry from the first tube segment to the second tube segment with the valve is in a closed position; and a valve actuation housing having a piston hydraulic chamber, a central bore extending axially through the valve actuation housing, and a fluid channel extending from the central bore to the piston hydraulic chamber, wherein the piston hydraulic chamber operates with respect to a pressure differential to cause a valve actuator to move the valve from an open to a closed position; wherein the fluid channel includes a plug disposed within the fluid channel to seal the piston hydraulic chamber from the central bore, wherein sealing the fluid channel hydraulically locks the valve in the open position, and an actuation mechanism connected to the fluid channel, the actuation mechanism configured to open the fluid channel to hydraulically unlock the valve, wherein opening the fluid channel generates a pressure differential that causes a valve actuator to move the valve from an open to a closed position.

Embodiment #12: The system of Embodiment #11, wherein the actuation mechanism includes an inner sleeve disposed within the central bore of the valve actuation housing, the inner sleeve configured to slide along the valve actuation housing to displace a portion of the plug to open a fluid path through the plug to the piston hydraulic chamber, wherein opening the fluid path to the piston hydraulic chamber hydraulically unlocks the valve and drives the valve to a closed position.

Embodiment #13: The system of Embodiment #11, wherein the actuation mechanism includes a hydraulic device disposed within the valve actuation housing, the hydraulic device configured to displace a portion of the plug to open a fluid path through the plug to the piston hydraulic chamber, wherein opening the fluid path to the piston hydraulic chamber hydraulically unlocks the valve and drives the valve to a closed position.

Embodiment #14: The system of Embodiment #11, further comprising a piston disposed within the piston chamber, wherein the piston is configured to apply a biasing force to the valve in response to opening the fluid path through the plug.

Embodiment #15: The system of Embodiment #11, wherein the valve comprises at least one seal configured to seal the connection with the first slurry tube segment.

Embodiment #16: The system of Embodiment #11, wherein the valve is an in-line valve placed between the first and second slurry tube segments to fluidically couple the first slurry tube segment, the valve and the second slurry tube segment in an approximately straight slurry pathway, and wherein the in-line valve includes at least one of a ball valve, a pinch valve, or a gate valve.

Embodiment #17: The system of Embodiment #11, wherein a piston closes the valve via a valve linkage when the fluid channel is open, wherein the valve linkage includes at least one of a lever arm, a worm drive with a worm gear, or a rack with a pinion.

Embodiment #18: A method for actuating a downhole shunt tube isolation system, comprising sealing a piston hydraulic chamber disposed within a valve actuator housing, via a plug, to hydraulically lock a valve in an open position, wherein a gravel slurry is configured to flow from a first tube segment through the valve to a second tube segment when the valve is in the open position; displacing a portion of the plug to open a fluid path through the plug to the piston hydraulic chamber, wherein opening the fluid path to the piston hydraulic chamber hydraulically unlocks the valve; and closing the valve via biasing force to block the flow of the gravel slurry from the first tube segment to the second tube segment, wherein the biasing force is generated by a pressure differential across the piston with the fluid path opened.

Embodiment #19: The system of Embodiment #18, wherein displacing a portion of the plug to open a fluid path through the plug to the piston hydraulic chamber includes actuating a mechanism disposed within the valve actuator housing to displace the portion of the plug.

Embodiment #20: The system of Embodiment #18, wherein displacing a portion of the plug to open a fluid path through the plug to the piston hydraulic chamber includes shifting an inner sleeve disposed within the valve actuator housing to displace the portion of the plug.

What is claimed is:

1. A downhole shunt tube isolation system, comprising:

a first slurry tube segment;

a second slurry tube segment;

a valve housing connected to the first and second slurry tube segments, the valve housing including a ball valve and a valve linkage, the ball valve rotating between an open position and a closed position via the valve linkage, the valve having a slurry pathway extending through at least a portion of the valve housing, wherein the slurry pathway fluidically couples the first slurry tube segment to the second slurry tube segment with the valve in the open position and fluidically decouples the first slurry tube segment from the second slurry tube segment with the valve in the closed position; and a valve actuation housing connected to the valve housing, the valve actuation housing including:

a valve actuator connected to the valve linkage;

a fluid channel connected to the valve actuator, the fluid channel initially closed to hydraulically lock the valve in the open position; and an actuation mechanism connected to the fluid channel and the valve actuator, the actuation mechanism configured to open the fluid channel to hydraulically unlock the valve, wherein opening the fluid channel generates a pressure differential that causes the valve actuator to move the valve from an open to a closed position, wherein the valve linkage converts linear motion by the valve actuator into rotational motion of the ball valve.

2. The system of claim 1, wherein the valve is an in-line valve that may be placed between the first and second slurry tube segments to fluidically couple the first slurry tube segment, the valve and the second slurry tube segment in an approximately straight slurry pathway.

3. The system of claim 1, wherein the valve is an in-line valve that may be actuated to fluidically decouple the first slurry tube segment from the second slurry tube segment.

4. The system of claim 1, wherein the valve actuator closes the valve via the valve linkage when the fluid channel is open.

5. The system of claim 4, wherein the valve actuator is a piston and the valve linkage is a lever arm connected to the valve.

6. The system of claim 4, wherein the valve actuator is a piston and the valve linkage is a worm drive with a worm gear connected to the valve.

7. The system of claim 4, wherein the valve actuator is a piston and the valve linkage is a rack with a pinion connected to the valve.

8. The system of claim 1, wherein the actuation mechanism includes a knockout plug positioned in the fluid channel to close the fluid channel, and a mechanical device configured to displace a portion of the plug to open a fluid path through the plug into the fluid channel to open the fluid channel.

9. The system of claim 8, wherein the mechanical device includes a hydraulic device configured to displace the portion of the plug to open the fluid channel.

10. A downhole shunt tube isolation system, comprising:

a first slurry tube segment;

a second slurry tube segment;

a valve housing, the valve housing including a ball valve connected to the first slurry tube segment and the second slurry tube segment, the ball valve configured to establish a gravel slurry pathway through the first slurry tube segment and the second slurry tube segment when the valve is in an open position and to block flow of the gravel slurry from the first tube segment to the second tube segment when the valve is in a closed position; and a valve actuation housing having a piston hydraulic chamber, a central bore extending axially through the valve actuation housing, and a fluid channel extending from the central bore to the piston hydraulic chamber, wherein the piston hydraulic chamber operates with respect to a pressure differential to cause a valve actuator to move the valve from an open to a closed position;

wherein the fluid channel includes a plug disposed within the fluid channel to seal the piston hydraulic chamber from the central bore, wherein sealing the fluid channel hydraulically locks the valve in the open position, and an actuation mechanism connected to the fluid channel, the actuation mechanism configured to open the fluid channel to hydraulically unlock the ball valve, wherein opening the fluid channel generates a pressure differential that causes a valve actuator to rotate the valve from an open to a closed position, wherein the valve linkage converts linear motion by the valve actuator into rotational motion of the ball valve.

11. The system of claim 10, wherein the actuation mechanism includes an inner sleeve disposed within the central bore of the valve actuation housing, the inner sleeve configured to slide along the valve actuation housing to displace a portion of the plug to open a fluid path through the plug to the piston hydraulic chamber, wherein opening the fluid path to the piston hydraulic chamber hydraulically unlocks the valve and drives the valve to a closed position.

12. The system of claim 10, wherein the actuation mechanism includes a hydraulic device disposed within the valve actuation housing, the hydraulic device configured to displace a portion of the plug to open a fluid path through the plug to the piston hydraulic chamber, wherein opening the fluid path to the piston hydraulic chamber hydraulically unlocks the valve and drives the valve to a closed position.

13. The system of claim 10, further comprising a piston disposed within the piston chamber, wherein the piston is configured to apply a biasing force to the valve in response to opening the fluid path through the plug.

14. The system of claim 10, wherein the valve comprises at least one seal configured to seal the connection with the first slurry tube segment.

15. The system of claim 10, wherein the valve is an in-line valve placed between the first and second slurry tube segments to fluidically couple the first slurry tube segment, the valve and the second slurry tube segment in an approximately straight slurry pathway.

16. The system of claim 10, wherein a piston closes the valve via a valve linkage when the fluid channel is open, wherein the valve linkage includes at least one of a lever arm, a worm drive with a worm gear, or a rack with a pinion.

17. A method for actuating a downhole shunt tube isolation system, comprising:

sealing a piston hydraulic chamber disposed within a valve actuator housing, via a plug, to hydraulically lock a ball valve in an open position, wherein the ball valve is configured to provide a gravel slurry pathway from a first tube segment through the valve to a second tube segment when the ball valve is in the open position;

displacing a portion of the plug to open a fluid path through the plug to the piston hydraulic chamber, wherein opening the fluid path to the piston hydraulic chamber hydraulically unlocks the ball valve; and rotating the ball valve into a closed position via biasing force to block the flow of the gravel slurry from the first tube segment to the second tube segment, wherein the biasing force is generated by a pressure differential across the piston with the fluid path opened, wherein the biasing force converts linear motion by the piston into rotational motion of the ball valve.

18. The method of claim 17, wherein displacing a portion of the plug to open a fluid path through the plug to the piston hydraulic chamber includes actuating a mechanism disposed within the valve actuator housing to displace the portion of the plug.

19. The method of claim 17, wherein displacing a portion of the plug to open a fluid path through the plug to the piston hydraulic chamber includes shifting an inner sleeve disposed within the valve actuator housing to displace the portion of the plug.

* * * * *